US005718119A

United States Patent [19]

Wakita et al.

[11] Patent Number: 5,718,119

[45] Date of Patent: Feb. 17, 1998

[54] REFRIGERATION SYSTEM AND METHOD OF INSTALLING SAME

[75] Inventors: Katsuya Wakita, Nara; Tetsuji Kawakami, Katano; Keizo Nakajima, Kawachi nagano; Shigehiro Sato, Osaka; Yusuke Ozaki, Toyonaka; Nobuo Sonoda, Settsu, all of Japan

[73] Assignee: Matsushita Electric Industrial Co., Ltd., Osaka, Japan

[21] Appl. No.: 686,607

[22] Filed: Jul. 26, 1996

[30] Foreign Application Priority Data

| | | | |
|---|---|---|---|
| Jul. 28, 1995 | [JP] | Japan | 7-192702 |
| Mar. 1, 1996 | [JP] | Japan | 8-043931 |
| Jul. 16, 1996 | [JP] | Japan | 8-185891 |

[51] Int. Cl.[6] ..... F25B 47/00

[52] U.S. Cl. ..... 62/85; 62/303

[58] Field of Search ..... 62/77, 84, 85, 62/292, 303, 468, 470

[56] References Cited

U.S. PATENT DOCUMENTS 5,375,426 12/1994 Burgener ..... 62/85

FOREIGN PATENT DOCUMENTS

| | | |
|---|---|---|
| 3-70953 | 3/1991 | Japan . |
| 7-159004 | 6/1995 | Japan . |
| 7-269994 | 10/1995 | Japan . |

*Primary Examiner*—John M. Sollecito

*Attorney, Agent, or Firm*—Wenderoth, Lind & Ponack

[57] ABSTRACT

A refrigeration system includes an outdoor unit having a refrigeration compressor and a heat exchanger, and an indoor unit having a heat exchanger to be placed where air conditioning is desired. In installing the refrigeration system, the outdoor unit is first connected with the indoor unit via pipe lines, and an air absorbing device containing zeolite as an adsorbent is subsequently placed on the outdoor unit, the indoor unit, or the pipe lines to remove air. The air absorbing device is then separated from the refrigeration system, and refrigerant is caused to circulate through the refrigeration system.

7 Claims, 5 Drawing Sheets

REFRIGERATION SYSTEM AND METHOD OF INSTALLING SAME

BACKGROUND OF THE INVENTION

1. Field of the Invention

The present invention relates to a refrigeration system with a refrigeration compressor such as, for example, a refrigerator or an air conditioner, and also relates to a method of installing the refrigeration system.

2. Description of Related Art

A refrigeration system for use in a refrigerator, a vending machine or an air conditioner generally comprises a refrigeration compressor, at least one heat exchanger, a refrigerant quantity controller having an expansion mechanism such as a capillary tube or an expansion valve, and pipe lines made up of, for example, copper pipes for connecting them. The refrigeration system also contains fluids such as a refrigerant or a lubricating oil.

In installing the refrigeration system, prior to filling with refrigerant, the refrigeration system is generally evacuated using a vacuum pump to thereby remove an air component contained therein.

Of various air conditioners, a separate-type air conditioner comprises an outdoor unit having a refrigeration compressor and a heat exchanger, an indoor unit having a heat exchanger to be placed at a location where air conditioning is desired, and connecting pipes such as, for example, copper pipes for connecting the outdoor and indoor units with each other. Before installation, the outdoor unit is generally filled with part or all of refrigerant and lubricating oil in advance, while valves for use in connecting the outdoor unit with the indoor unit are closed. During installation, the outdoor and indoor units are connected with each other by the connecting pipes.

However, a mere connection of the outdoor and indoor units cannot complete the refrigeration system because air still remains in the indoor unit and the connecting pipes. Because of this, a vacuum pump is connected to a service port defined in one of the valves of the outdoor unit to remove air and, upon evacuation, the valves are opened to fluidly connect the outdoor and indoor units to thereby complete the refrigeration system.

In a simplified installation, one of the valves of the outdoor unit is opened to allow the refrigerant in the outdoor unit to flow through the connecting pipes and the indoor unit, and to release air together with part of the refrigerant through a service port defined in the other valve or through a space formed by loosening a joint between this valve and the pipe line connected thereto, thereby replacing air inside the indoor unit and the connecting pipes with the refrigerant.

Japanese Laid-Open Patent Publication (unexamined) No. 3-70953 discloses a method of charging a refrigeration system with refrigerant without using a vacuum pump. According to this method, gas in the refrigeration system is first replaced with oxygen, and the refrigeration system is subsequently charged with the refrigerant, while oxygen contained therein is chemically fixed by oxygen fixatives incorporated therein.

Japanese Laid-Open Patent Publication (unexamined) No. 7-159004 discloses a refrigeration cycle of a separate-type comprising a refrigeration compressor, a condenser, an expansion mechanism having a capillary tube or an expansion valve, and an evaporator. The refrigeration cycle contains an absorbent sealed therein capable of absorbing more than two of moisture, oxygen, nitrogen, carbon dioxide and the like, all of which are contained in air.

Japanese Laid-Open Patent Publication (unexamined) No. 7-269994 discloses a refrigeration system containing an oxygen absorbent capable of absorbing oxygen contained in a refrigerant circulating line.

Because air remaining in the refrigeration system is a non-condensable gas which lowers the refrigerating capacity and because oxygen and moisture promote deterioration of material inside the refrigeration system, it is necessary to remove the air.

Of the conventional methods, the use of a vacuum pump to evacuate the refrigeration system requires a power source at an installation site if the refrigeration system is used in a separate-type air conditioner. Accordingly, this method is not always convenient.

The method of replacing air with refrigerant is followed by an undesirable release of refrigerant or Freon to the atmosphere. In consideration of global environments, this method is undesirable because it causes ozone layer damage or global warming.

The method as disclosed in the above Japanese Laid-Open Patent Publication (unexamined) No. 3-70953 is not so effectual because lubricating oil contained in the refrigeration system is rapidly adversely affected by oxygen. Also, it is likely that the refrigerant or the lubricating oil is adversely affected by the oxygen fixatives.

The method as disclosed in the above Japanese Laid-Open Patent Publication (unexamined) No. 7-159004 is likely to cause a problem in that the refrigerant or the lubricating oil is adversely affected by the absorbent sealed in the refrigeration cycle.

The method as disclosed in the above Japanese Laid-Open Patent Publication (unexamined) No. 7-269994 is likely to cause a problem in that the refrigerant or the lubricating oil is adversely affected by the oxygen absorbent.

SUMMARY OF THE INVENTION

The present invention has been developed to overcome the above-described disadvantages.

It is accordingly an objective of the present invention to provide an easy-to-install refrigeration system of a simple construction capable of preventing entry of air thereinto during installation.

Another objective of the present invention is to provide a refrigeration system which does not allow an undesirable discharge of refrigerant into the atmosphere and is therefore safe for the environment.

A further objective of the present invention is to provide a method of installing the refrigeration system of the above-described type.

In accomplishing the above and other objectives, the method of the present invention is intended to install a refrigeration system which includes an outdoor unit having a refrigeration compressor and a heat exchanger, and an indoor unit having a heat exchanger to be placed where air conditioning is desired. The method of the present invention comprises the steps of: connecting the outdoor unit with the indoor unit via pipe lines; placing an air absorbing device containing zeolite as an adsorbent on one of the outdoor unit, the indoor unit, and the pipe lines to remove air; separating the air absorbing device from the refrigeration system; and circulating refrigerant through the refrigeration system.

Advantageously, after the use of zeolite, the adsorptivity thereof is recovered so that zeolite may be used repeatedly.

It is preferred that carbon dioxide is sealed in the indoor unit in advance.

It is also preferred that zeolite has an average pore size greater than 0.4 nm.

It is further preferred that the air absorbing device contains more than 20 grams of zeolite per 1 liter of air contained in the indoor unit and the pipe lines.

In another form of the present invention, the method of installing the refrigeration system comprises the steps of: connecting the outdoor unit with the indoor unit via pipe lines; replacing the inside of the indoor unit or the pipe lines with carbon dioxide; placing a carbon dioxide absorbing device on one of the outdoor unit, the indoor unit, and the pipe lines to remove carbon dioxide; separating the carbon dioxide absorbing device from the refrigeration system; and circulating refrigerant through the refrigeration system.

Conveniently, the carbon dioxide absorbing device contains zeolite, calcium hydroxide and calcium chloride, or an epoxy compound.

The method of the present invention is also intended to install a refrigeration system including a refrigeration compressor, a heat exchanger, one of a capillary tube and an expansion valve, and pipe lines for connecting them. This method comprises the steps of: filling at least part of the refrigeration system with an inert gas; placing a condensing and collecting device on the refrigeration system to cool the inert gas below a condensation temperature thereof, thereby condensing and collecting the inert gas; separating the condensing and collecting device from the refrigeration system; and circulating refrigerant through the refrigeration system.

On the other hand, the refrigeration system of the present invention comprises a refrigeration compressor, at least one heat exchanger connected with the refrigeration compressor, one of a capillary tube and an expansion valve connected with the heat exchanger and, a carbon dioxide absorbing device containing an epoxy compound and placed on the refrigeration system, wherein at least part of the refrigeration system is filled with carbon dioxide, which is in turn absorbed by the carbon dioxide absorbing device.

Advantageously, the carbon dioxide absorbing device comprises an oil separation mechanism fitted to a refrigerant flow channel leading thereto.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Figure 1:
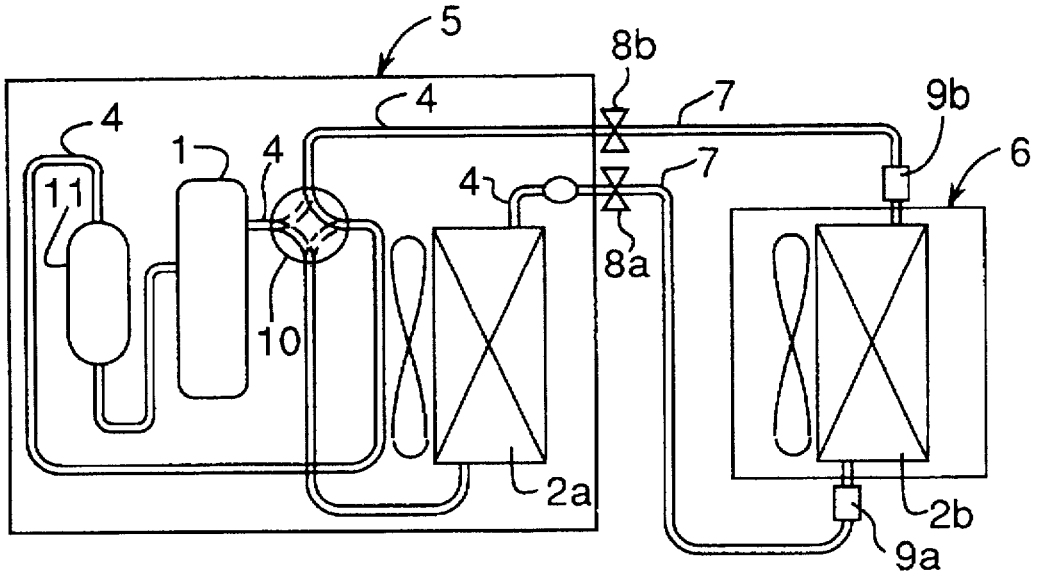
FIG. 1 is a refrigeration system to which an installation method of the present invention is applied.

Referring now to the drawings, there is shown in FIG. 1 a refrigeration system embodying the present invention. The refrigeration system shown therein comprises an outdoor unit 5, an indoor unit 6, valves 8*a* and 8*b*, connecting members 9*a* and 9*b* such as, for example, flared joints, and pipe lines 7 for connecting them. The outdoor unit 5 includes a refrigeration compressor 1, a heat exchanger 2*a*, a refrigerant quantity controller 3 such as a capillary tube or an expansion valve, and pipe lines 4 for connecting them, while the indoor unit 6 includes a heat exchanger 2*b* to be placed at a location where air conditioning is desired. The outdoor unit 5 also includes a four-way valve 10 for switching between the condensing or evaporating function of the heat exchanger 2*a*and that of the heat exchanger 2*b*. The outdoor unit 5 may include an accumulator 11, as shown in FIG. 1.

During a cooling operation, refrigerant compressed by the refrigeration compressor 1 radiates heat and is partially liquefied. The refrigerant thus liquefied passes through the refrigerant quantity controller 3 and turns into a low-temperature refrigerant of a vapor-liquid mixed phase. The refrigerant is then introduced into the heat exchanger 2*b* of the indoor unit 6 in which the refrigerant absorbs heat and is vaporized. Thereafter, the refrigerant is again sucked into the refrigeration compressor 1. When a warming operation is desired, the four-way valve 10 is operated to switch the flow channel. By so doing, the heat exchanger 2*b* operates to condense the refrigerant, while the heat exchanger 2*a* operates to evaporate it.

During installation of the refrigeration system of the above-described construction, an air absorbing device containing or retaining zeolite employed as an absorbent is mounted on either the outdoor unit 5 or the indoor unit 6, or fitted to a predetermined position of the pipe lines 7 to remove air. Upon removal of air, the air absorbing device is separated from the refrigeration system, and the refrigerant is caused to circulate through the refrigeration system.

Figure 2:
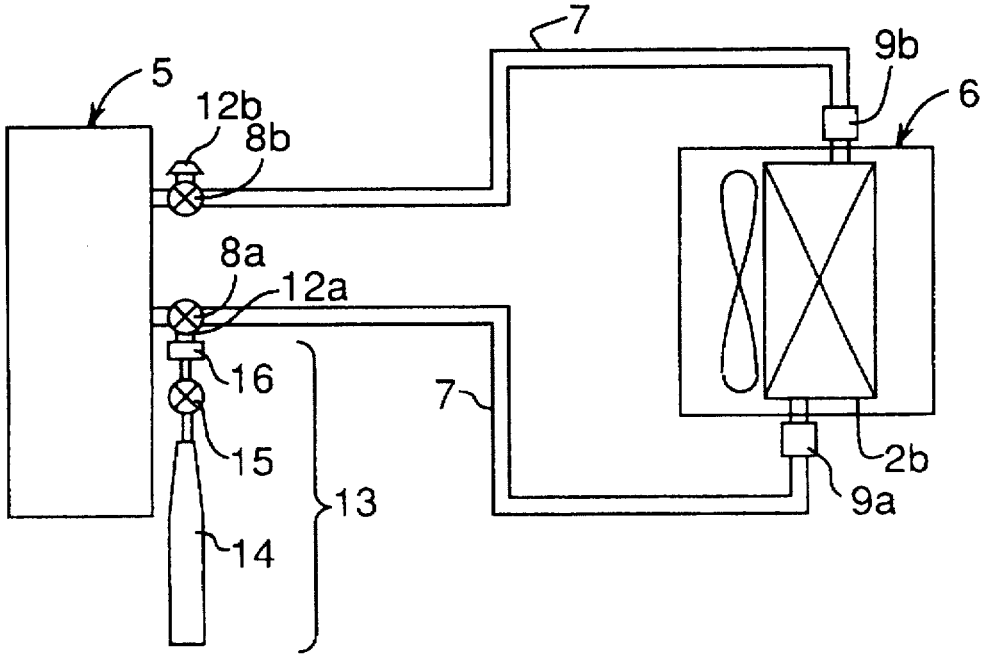
FIG. 2 is a schematic view indicating a method of installing the refrigeration system wherein an air absorbing device is connected thereto during installation.

By way of example, as shown in FIG. 2, the outdoor unit 5 and the indoor unit 6 are first connected with each other using pipe lines 7, two- or three-way valves 8*a* and 8*b* having, for example, respective flared joints, and connecting members 9*a* and 9*b*. The connecting members 9*a* and 9*b* may be flared joints The valves 8*a* and 8*b*, which serve to connect outdoor unit side flow channels with indoor unit side flow channels via the pipe lines 7, are therefore provided with respective ports for connection to the pipe lines 7. The valves 8*a* and 8*b* are also provided with additional ports 12*a* and 12*b*, respectively, through which evacuation by a vacuum pump (not shown) is carried out or additional refrigerant is charged. Because these ports 12a and 12b always communicate with the pipe lines 7 irrespective of the opening and closing of the valves 8a and 8b, a port having a plunger is used for each of the ports 12a and 12b to prevent leakage of the refrigerant when the refrigeration system is not being evacuated or additionally charged or when air is not being removed. Accordingly, when not in use, such ports 12a and 12b are required to be positively sealed by, for example, seal caps.

The number of ports may be one, to which an air absorbing device 13 containing zeolite as an adsorbent therein is connected. Because the air absorbing device 13 becomes unnecessary after removal of air from the system and because zeolite is likely to adsorb the refrigerant due to its high physical adsorptivity, it is preferred that the air absorbing device 13 be removed after removal of the air.

The air absorbing device 13 comprises a vessel 14 containing zeolite, a valve 15 for preventing zeolite from contacting air when not in use, and a port connector 16 having a plunger pusher. The port connector 16 is first connected to the port 12a having a plunger with the valve 15 closed. At this moment, the valves 8a and 8b are closed to separate the outdoor and indoor units 5 and 6 from each other. The valve 15 is subsequently opened to allow zeolite to come into contact with air inside the indoor unit 6 and the pipe lines 7. After leaving the air absorbing device 13 as it is for a predetermined period of time, the valve 15 is closed and the port connector 16 is separated from the port 12a. Then, the air absorbing device 13 is removed and the port 12a is covered with seal cap. Subsequent opening of the valves 8a and 8b allows the outdoor and indoor units 5 and 6 to communicate with each other, thus completing installation of the refrigeration system.

It is well known that zeolite absorbs moisture and is therefore used in a refrigerator or an air conditioner to remove moisture contained in a refrigeration system. We have discovered that even if zeolite absorbs air, i.e., nitrogen, oxygen, carbon dioxide and the like at room temperatures, it can still be repeatedly used. Also, we have made clear that the installation of the refrigeration system can be simplified by using zeolite during installation.

Before use, it is necessary to fully degas the zeolite contained in the air absorbing device 13 using a vacuum pump. However, it is not necessary to carry out degassing immediately before the installation of the refrigeration system, and it is convenient and preferable to carry the air absorbing device 13 containing zeolite degassed in advance with the valve 15 closed. The degassing rate can be increased by heating the vessel 14 of the air absorbing device 13.

The amount of zeolite contained in the air absorbing device 13 depends on the amount of air to be removed, and more than 20 grams of the former per 1 liter of the latter is preferable to increase the degassing rate.

It is also preferred that the indoor unit 6 is filled with carbon dioxide because such gas can be rapidly removed from the indoor unit 6. The indoor unit 6 can be filled with carbon dioxide before shipment, or the indoor unit 6 and the pipe lines 7 can be filled with carbon dioxide at an installation site. Filling before shipment is preferred.

The use of zeolite having an average pore size greater than 0.4 nm prevents moisture inside the indoor unit 6 from reducing the air adsorbing rate, and rapidly removes air inside the indoor unit 6. The use of zeolite having an average pore size of about 1.0 nm considerably increases the air adsorbing rate and is most preferable. The shape of zeolite is not limited to a specific one, but a spherical shape is resistant to being broken and is therefore preferred.

Although in FIG. 2 the air absorbing device 13 is connected to the valve 8a, the former may be connected to the valve 8b. Furthermore, before the valves 8a and 8b are opened, the refrigeration system may be additionally charged with refrigerant.

Figure 3:
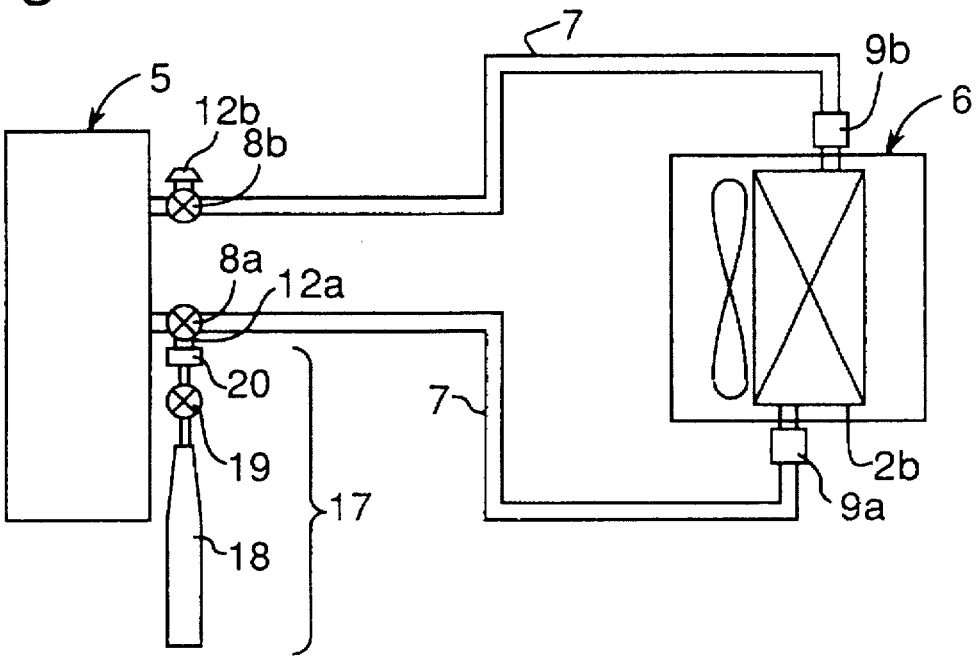
FIG. 3 is a schematic view indicating another method of installing the refrigeration system wherein a carbon dioxide generating device is connected thereto during installation.
Figure 4:
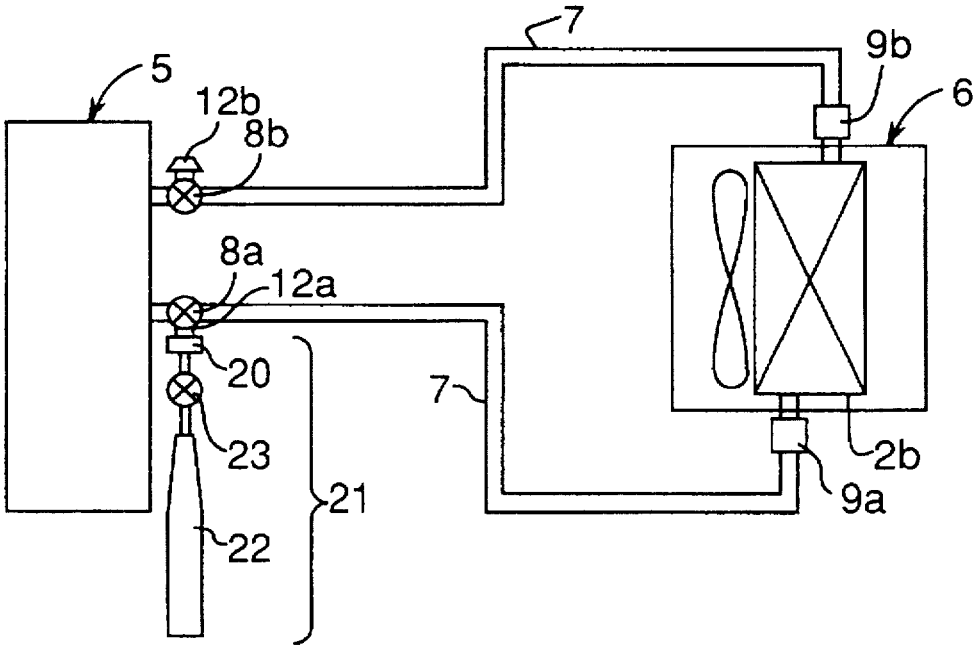
FIG. 4 is a view similar to FIG. 4, but indicating the refrigeration system wherein a carbon dioxide absorbing device is connected thereto after the carbon dioxide generating device shown in FIG. 3 has been removed.

FIGS. 3 and 4 depict another installation method wherein air inside the indoor unit 6 and the pipe lines 7 is first replaced with carbon dioxide, which is in turn removed by a carbon dioxide absorbing device mounted on either the outdoor unit 5 or the indoor unit 6, or fitted to a predetermined position of the pipe lines 7, and wherein the carbon dioxide absorbing device is then separated from the refrigeration system, and refrigerant is caused to circulate through the refrigeration system.

As shown in FIG. 3, the outdoor unit 5 and the indoor unit 6 are first connected with each other using the pipe lines 7, the valves 8a and 8b, and the connecting members 9a and 9b. The valves 8a and 8b, which serve to connect outdoor unit side flow channels with the pipe lines 7, are therefore provided with respective ports for connection to the pipe lines 7. The valves 8a and 8b are also provided with additional ports 12a and 12b, respectively, through which evacuation by a vacuum pump (not shown), charging of carbon dioxide or additional charging of refrigerant is carried out. A carbon dioxide generating device 17 is connected to one (12a) of the ports 12a and 12b, while the other (12b) of them is opened. If the valve 8b is provided with no port, a joint between it and the pipe line connected thereto is loosened. Thereafter, carbon dioxide from the carbon dioxide generating device 17 is introduced into the refrigeration system so that the inside of the indoor unit 6 and the pipe lines 7 is replaced with carbon dioxide.

Upon replacement, the introduction of carbon dioxide from the carbon dioxide generating device 17 is stopped, and the port 12b not connected to the carbon dioxide generating device 17 is closed or the joint between it and the pipe line connected thereto is tightened again. Thereafter, as shown in FIG. 4, a carbon dioxide absorbing device 21 is connected to one of the ports 12a and 12b. Because the carbon dioxide absorbing device 21 becomes unnecessary after removal of carbon dioxide from the system and because carbon dioxide absorbing material contained in the carbon dioxide absorbing device 21 is likely to react with refrigerant or lubricating oil, the carbon dioxide absorbing device 21 may be removed after removal of carbon dioxide.

The carbon dioxide generating device 17 comprises a vessel 18 filled with carbon dioxide or with materials such as, for example, calcium carbonate and acid which chemically generate carbon dioxide when mixed with each other. The carbon dioxide generating device 17 also comprises a valve 19 and a port connector 20 having a plunger pusher.

On the other hand, the carbon dioxide absorbing device 21 comprises a vessel 22 filled with material for absorbing carbon dioxide, a valve 23 for preventing the carbon dioxide absorbing material from contacting with the open air when not in use, and a port connector 20 having a plunger pusher. The port connector 20 is first connected to the port 12a having a plunger with the valve 23 closed, to thereby connect the carbon dioxide absorbing device 21 to the indoor unit 6 and the pipe lines 7. At this moment, the valves 8a and 8b are closed to separate the outdoor and indoor units 5 and 6 from each other. The valve 23 is subsequently opened to allow the carbon dioxide absorbing material in the vessel 22 to come into contact with carbon dioxide inside the indoor unit 6 and the pipe lines 7. After leaving the carbon dioxide absorbing device 21 as it is for a predetermined period of time, the valve 23 is closed and the port connector 20 is separated from the port 12*a*. Then, the carbon dioxide absorbing device 21 is removed and the port 12*a* is covered with a seal cap. Subsequent opening of the valves 8*a* and 8*b* allows the outdoor and indoor units 5 and 6 to communicate with each other, thus completing installation of the refrigeration system.

Although in FIG. 4 the carbon dioxide absorbing device 21 is connected to the valve 8*a*, the former may be connected to the valve 8*b* or a valve mounted on the indoor unit 6 if the valve has the same function as the valve 8*b*. Furthermore, before the valves 8*a* and 8*b* are opened, the refrigeration system may be additionally charged with refrigerant.

Figure 5:
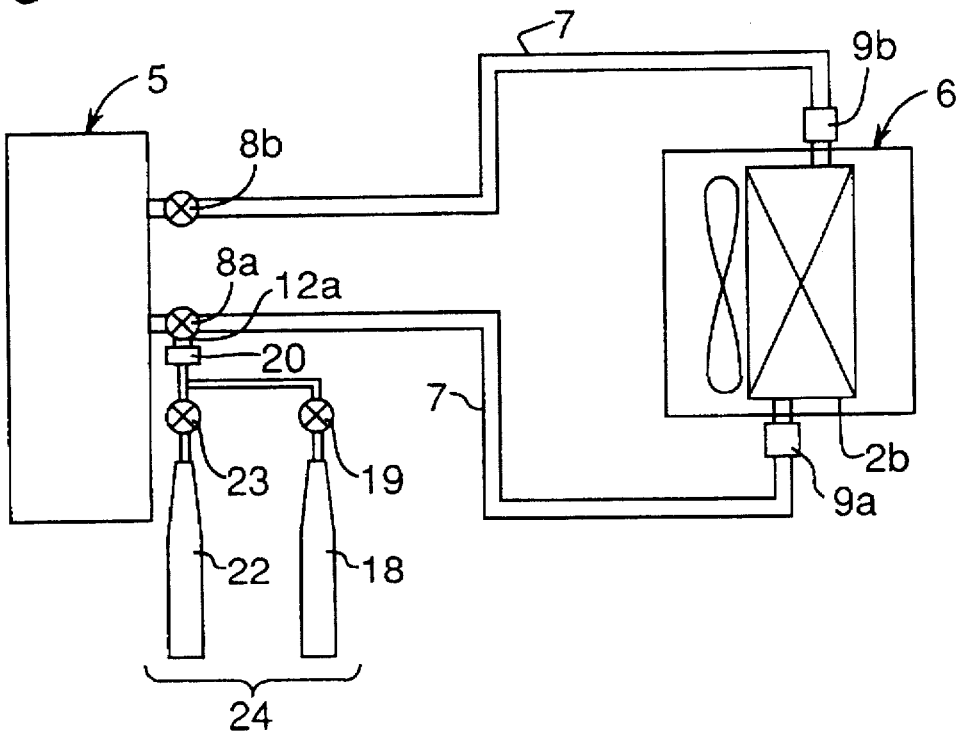
FIG. 5 is a schematic view indicating a further method of installing the refrigeration system wherein a device of an integral structure comprising a carbon dioxide generating device and a carbon dioxide absorbing device is connected thereto during installation.

As shown in FIG. 5, one of the valves 8*a* and 8*b*, which serve to connect outdoor unit side flow channels with the pipe lines 7, may be provided with no port if the other is provided with a port through which evacuation by a vacuum pump, charging of carbon dioxide or additional charging of refrigerant is carried out. Even in such a case, it is possible to replace the inside of the indoor unit 6 and the pipe lines 7 with carbon dioxide.

More specifically, a device 24 of an integral structure comprising a carbon dioxide generating device and a carbon dioxide absorbing device is first connected to the port 12*a* with a plunger via the port connector 20 with a plunger pusher. A joint between the valve 8*b* with no port and the pipe line connected thereto is subsequently loosened to allow leakage of gas in the system. The valve 19 is then opened to introduce carbon dioxide from the vessel 18, which is filled with carbon dioxide or with materials such as, for example, calcium carbonate and acid which chemically generate carbon dioxide when mixed with each other. Upon replacement, the valve 19 is closed to stop further introduction of carbon dioxide into the system, and the loosened joint is tightened completely. Subsequent opening of the valve 23 allows the vessel 22 filled with the carbon dioxide absorbing material to communicate with the system, thus enabling absorption of carbon dioxide in the system.

Upon absorption of carbon dioxide, the valve 23 is closed, and the device 24 of the integral structure is removed from the port 12*a*.

Zeolite can be used for the carbon dioxide absorbing material contained in the vessel 22. We have discovered that zeolite can effectively absorb nitrogen at room temperatures and can be repeatedly used, and have made clear that the installation of the refrigeration system can be simplified by using zeolite during installation.

Before use, it is necessary to fully degas zeolite contained in the vessel 22 of the carbon dioxide absorbing device using a vacuum pump. However, it is not necessary to carry out degassing immediately before the installation of the refrigeration system, and it is convenient and preferable to carry the carbon dioxide absorbing device containing zeolite degassed in advance with the valve 23 closed. The degassing rate can be increased by heating the vessel 22 of the carbon dioxide absorbing device.

The amount of zeolite contained in the carbon dioxide absorbing device depends on the amount of carbon dioxide to be removed, and more than 20 grams of the former per 1 liter of the latter is preferable to increase the degassing rate.

The use of zeolite having an average pore size greater than 0.4 nm prevents moisture inside the indoor unit 6 from reducing the carbon dioxide adsorbing rate, and rapidly removes gas inside the indoor unit 6. The use of zeolite having an average pore size of about 1.0 nm considerably increases the adsorbing rate and is most preferable. The shape of zeolite is not limited to a specific one, but a spherical shape is resistant to being broken and is therefore preferred.

Specific examples of a different carbon dioxide absorbing material contained in the carbon dioxide absorbing device are calcium hydroxide and a mixture of calcium hydroxide and calcium chloride.

Also, an epoxy compound is preferably used for the carbon dioxide absorbing material contained in the carbon dioxide absorbing device. Specific examples of the epoxy compound are monofunctional and polyfunctional epoxy compounds such as epoxyethane, 1,2-epoxypropane, 1,2-epoxybutane, 2,3-epoxybutane, 1,2-epoxyhexane, 1,2-epoxyoctane, 3,4-epoxy-1-propene, styrene oxide, cyclohexene oxide, glycidyl phenyl and perfluoropropylene oxide; a glycidyl ester compound such as glycidyl acetate ester, glycidyl propionate ester, diglycidyl adipate ester; and a glycidyl ether compound such as phenyl glycidyl ether, trimethylsilylglycidyl ether, resorcin diglycidyl ether and aryl glycidyl ether.

For the absorption of carbon dioxide by the epoxy compound, an organic zinc compound or a magnesium-based catalyst may be used as a reaction catalyst.

Specific examples of the reaction catalyst are an organic zinc catalyst and inorganic catalyst, for example, a substance prepared by reacting dialkylzinc or dialkylmagnesium with a divalent active hydrogen compound such as water, a primary amine, a divalent phenol, an aromatic dicarboxylic acid, an aromatic hydroxycarboxylic acid in a reaction molar ratio of 1:1, diethylzinc/γ-alumina, zinc carbonate, zinc acetate, cobalt acetate, zinc chloride/tetrabutylammonium bromide; a triethylaluminum/Lewis base catalyst; and an aluminum compound catalyst such as diethylaluminumdiethylamide and α, β, γ, δ-tetraphenylporphinatoaluminum methoxide.

Although absorption of carbon dioxide by the epoxy compound readily takes place at room temperatures, heating the vessel containing the carbon dioxide absorbing material by mounting, for example, a heater on the carbon dioxide absorbing device 21 is preferable for a higher reaction rate.

Specific examples of a further different carbon dioxide absorbing material contained in the carbon dioxide absorbing device are cyclic imine compound such as propyleneimine, four-membered ring ether such as oxetane, formaldehyde, a three-membered amine such as methyl aziridine, a conjugated diene such as butadiene and isoprene, propylenesulfide, ethylenephenyl phosphite, a mixture of phosphite ester and aromatic primary amine or aromatic diamine, and a mixture of crown ether, alkyl dihalide and metal dialkoxide.

Figure 6:
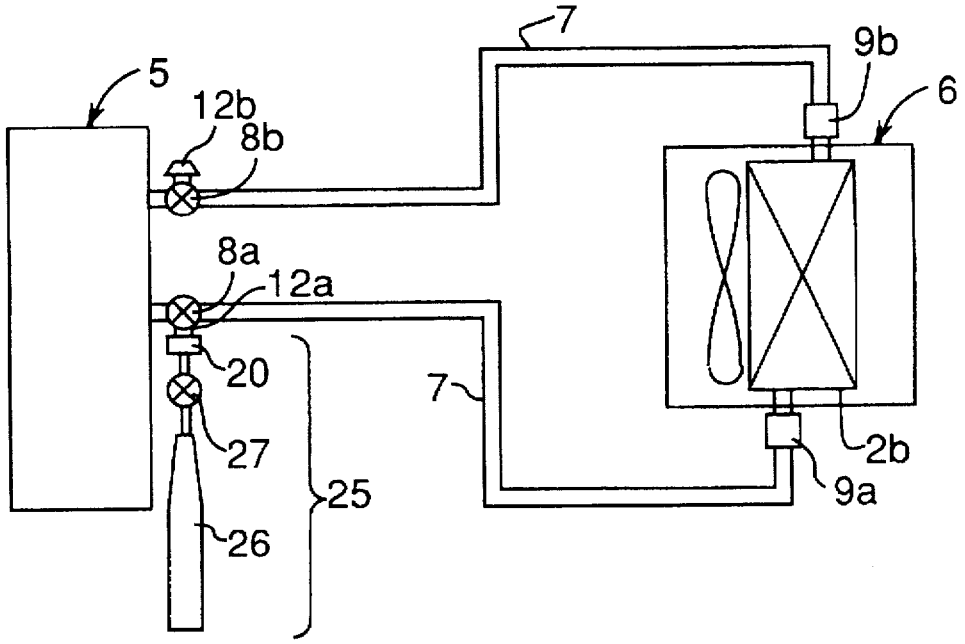
FIG. 6 is a schematic view indicating a still further method of installing the refrigeration system wherein an inert gas generating device is connected thereto during installation.
Figure 7:
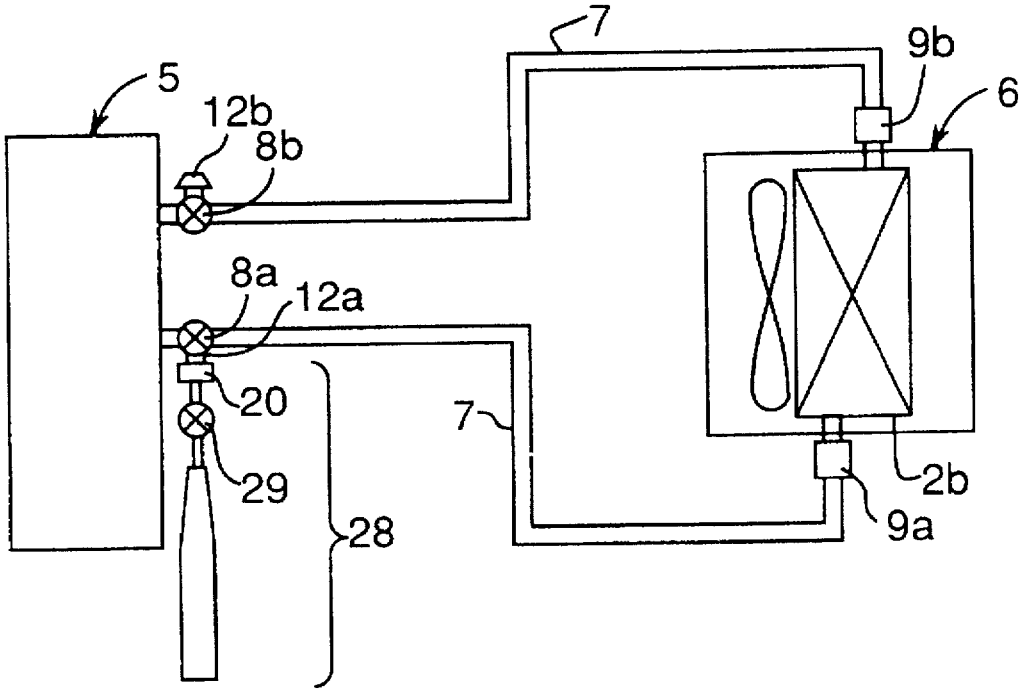
FIG. 7 is a view similar to FIG. 6, but indicating the refrigeration system wherein an inert gas condensing and collecting device is connected thereto after the inert gas generating device shown in FIG. 6 has been removed.

FIGS. 6 and 7 depict a different installation method wherein the refrigeration system is first partially or entirely filled with inert gas, which is in turn cooled below its condensation temperature for condensation thereof and is collected by a condensing and collecting device fitted to the refrigeration system, and wherein the condensing and collecting device is subsequently separated from the refrigeration system, and refrigerant is caused to circulate through the refrigeration system.

As shown in FIG. 6, an inert gas generating device 25 is first connected to one (12*a*) of the ports 12*a* and 12*b* with the other (12*b*) opened. Subsequent opening of a valve 27 introduces the inert gas in the inert gas generating device 25 into the refrigeration system to replace gas contained in the indoor unit 6 and the pipe lines 7 with the inert gas. The valve 27 is then closed to stop the introduction of the inert gas from the inert gas generating device 25 into the refrigeration system, and the port 12b not connected to the inert gas generating device 25 is closed.

Thereafter, as shown in FIG. 7, an inert gas condensing and collecting device 28 is connected to one of the ports 12a and 12b. Because the inert gas condensing and collecting device 28 becomes unnecessary after removal of the inert gas from the system, the inert gas condensing and collecting device 28 may be removed after the inert gas has been condensed and collected.

The inert gas generating device 25 comprises a cylinder 26 filled with an inert gas.

On the other hand, the inert gas condensing and collecting device 28 condenses and collects the inert gas by cooling it below its condensation temperature. The inert gas condensing and collecting device 28 is provided with a valve 29 for preventing an undesired entry of the open air therein when not in use.

During installation of the refrigeration system, under the condition in which the valve 29 is closed, the inert gas condensing and collecting device 28 is first connected to the port 12a with a plunger via a port connector 20 with a plunger pusher. The valve 29 is then opened to allow the inert gas condensing and collecting device 28 to communicate with the indoor unit 6 and the pipe lines 7. At this moment, the valve 8b is closed to separate the outdoor and indoor units 5 and 6 from each other. After leaving the inert gas condensing and collecting device 28 as it is for a predetermined period of time, the valve 29 is closed and the port connector 20 is separated from the port 12a. Then, the inert gas condensing and collecting device 28 is removed from the refrigeration system. The installation of the refrigeration system is completed by opening the valves 8a and 8b.

Typical examples of a condensable and collectable inert gas are argon, nitrogen and carbon dioxide. Although not an inert gas, hydrocarbon gas such as, for example, methane, ethane, propane, butane, or isobutane can be also used because it can be condensed and collected at relatively high temperatures without exerting influence on elements constituting the refrigeration system.

The inert gas condensing and collecting device 28 includes a vessel having a Peltier cooling device or a vessel containing a refrigerant such as, for example, liquid nitrogen.

Figure 8:
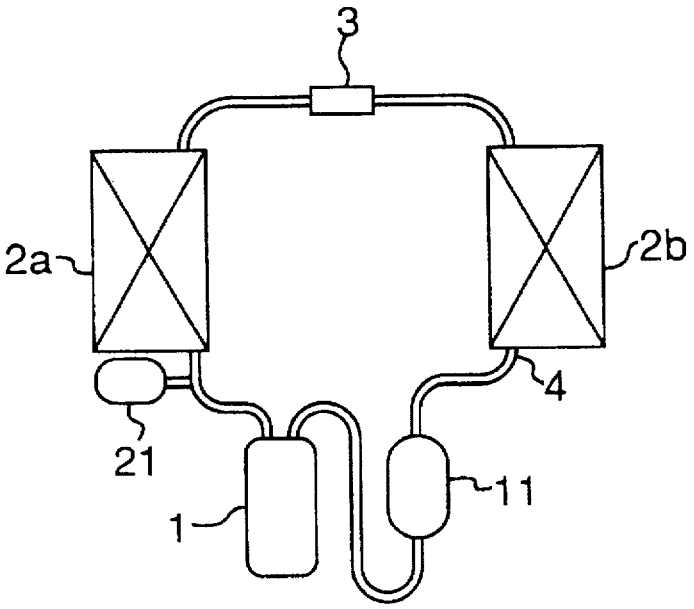
FIG. 8 is a schematic view of a refrigeration system according to the present invention.

FIG. 8 depicts a refrigeration system embodying the present invention, which comprises a refrigeration compressor 1, heat exchangers 2a and 2b, a capillary tube or an expansion valve 3, a carbon dioxide absorbing device 21 containing or retaining an epoxy compound, and pipe lines 4 for connecting them. The carbon dioxide absorbing device 21 may also contain a catalyst for enhancing carbon dioxide absorption by the epoxy compound. Although the position where the carbon dioxide absorbing device 21 is installed is not limited to a specific position, the rate of carbon dioxide absorption by the epoxy compound is increased at high temperatures and, hence, a position between the refrigeration compressor 1 and the heat exchanger for condensing refrigerant is most preferable.

If a lubricating oil is ester-based, it may be deteriorated in the presence of other compounds. It is therefore preferred that an oil separation mechanism be fitted to a refrigerant flow channel leading to the carbon dioxide absorbing device 21 so that a gaseous composition consisting essentially of oil-free refrigerant may come into contact with the carbon dioxide absorbing material containing the epoxy compound.

prior to circulating the refrigerant through the whole refrigeration system, the system is initially partially or entirely charged with carbon dioxide, which is in turn absorbed by the carbon dioxide absorbing device 21 for a relatively short period of time. The refrigerant may, however, be circulated before or after the operation of the carbon dioxide absorbing device 21.

Installation of the refrigeration system of the above-described construction can be readily completed without the need of purging air remaining inside the refrigeration system using a vacuum pump or the refrigerant.

(EMBODIMENT 1)

An outdoor unit 5 comprising a refrigeration compressor 1, a heat exchanger 2a and a capillary tube 3, and an indoor unit 6 comprising a heat exchanger 2b to be placed where air conditioning is desired were first fixed at their installation positions. These units 5 and 6 were subsequently connected with each other by pipe lines 7 to construct a refrigeration system as shown in FIG. 1. HFC refrigerant and an ester-based lubricating oil were respectively sealed in the outdoor unit 5 and in the refrigeration compressor 1 of the outdoor unit 5 in advance. The indoor unit 6 was filled with air, the volume of which was about 1,000 $cm^3$.

Thereafter, an air absorbing device 13 containing or retaining zeolite as an adsorbent was prepared as follows. In a nitrogen atmosphere, 100 grams of zeolite ("molecular sieve" manufactured by E. Merck and having a pore size of 1.0 nm) was accommodated in a 100 $cm^3$ stainless vessel, and a ball valve was fitted thereto to selectively open or close its mouth. Then, a vacuum pump having an evacuation rate of 120 l/min was connected to the ball valve via a rubber hose, and the vessel was evacuated for one hour while being heated by a dryer. After the ball valve was closed, the vacuum pump was removed from the vessel. Thereafter, a port connector with a plunger pusher was connected to the ball valve to complete the air absorbing device 13, which was in turn connected to the port 12a of the three-way valve 8a, as shown in FIG. 2. The valve 15 of the air absorbing device 13 was then opened to expose zeolite to air in the indoor unit 6 and the pipe lines 7. Upon the lapse of 30 minutes, the valve 15 was closed, and the air absorbing device 13 was removed. The port 12a was covered with a seal cap, and the valves 8a and 8b were opened to introduce the refrigerant into the indoor unit 6.

After a 3,000-hour continuous operation of the refrigeration system, the lubricating oil was taken out for observation. Deterioration of the lubricating oil by oxidation was not observed, and the lubricating oil still had a total acid number of 0.02 mgKOH/g, which made no substantial difference from an initial value (0.01 mgKOH/g, exhibited at the start of the operation.

(EMBODIMENT 2)

A vacuum pump having an evacuation rate of 120 l/min was connected via a rubber hose to the air absorbing device 13 containing zeolite as an adsorbent and used in Embodiment 1. The air absorbing device 13 was again evacuated for one hour while being heated by a dryer. In this way, zeolite was again used during installation of substantially the same refrigeration system as that of Embodiment 1.

After a 3,000-hour continuous operation of the refrigeration system, the lubricating oil was taken out for observation thereof. Deterioration of the lubricating oil by oxidation was not observed, and the lubricating oil still had a total acid number of 0.03 mgKOH/g, which made no substantial difference from the initial value (0.01 mgKOH/g) exhibited at the start of the operation.

The air absorbing device 13 thus used twice was further used in the same manner as in Embodiment 1. After a 3,000-hour continuous operation of the refrigeration system, the lubricating oil was taken out for observation thereof. Deterioration of the lubricating oil by oxidation was not observed, and the lubricating oil still had a total acid number of 0.02 mgKOH/g, which made no substantial difference from the initial value (0.01 mgKOH/g) exhibited at the start of the operation.

(EMBODIMENT 3)

A two-way valve was fitted to each of two connecting portions of the indoor unit 6, and carbon dioxide was introduced into the system though one of them so that the heat exchanger 2b to be placed where air conditioning is desired may be filled with carbon dioxide. The amount of sealed carbon dioxide was about 1,000 $cm^3$. The two valves were then closed.

Thereafter, the outdoor and indoor units 5 and 6 were fixed at their installation positions and connected with each other by the pipe lines 7, to thereby construct a refrigeration system as shown in FIG. 1. HFC refrigerant and ester-based lubricating oil were respectively sealed in the outdoor unit 5 and in the refrigeration compressor 1 of the outdoor unit 5 in advance.

Figure 9:
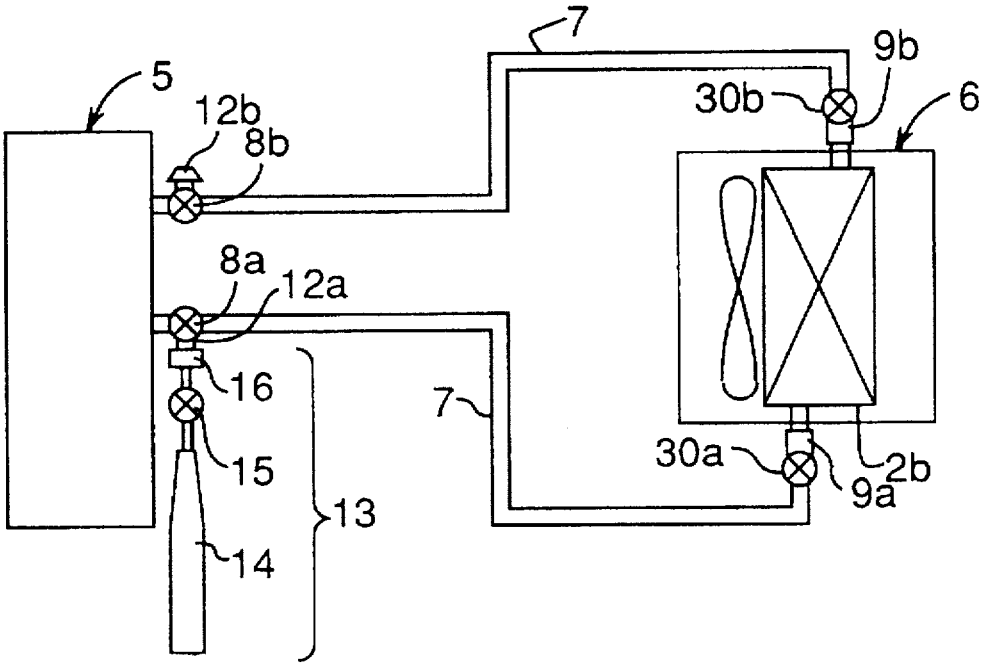
FIG. 9 is a view similar to FIG. 2, but indicating a refrigeration system wherein an indoor unit has two valves connected thereto at a refrigerant inlet and outlet thereof.

Thereafter, an air absorbing device 13 containing or retaining zeolite as an adsorbent was prepared as follows. In a nitrogen atmosphere, 100 grams of zeolite ("molecular sieve" manufactured by E. Merck and having a pore size of 1.0 nm) was accommodated in a 100 $cm^3$ stainless vessel, and a ball valve was fitted thereto to selectively open or close its mouth. Then, a vacuum pump having an evacuation rate of 120 l/min was connected to the ball valve via a rubber hose, and the vessel was evacuated for one hour while being heated by a dryer. After the ball valve was closed, the vacuum pump was removed from the vessel. Thereafter, a port connector with a plunger pusher was connected to the ball valve to complete the air absorbing device 13, which was in turn connected to the port 12a of the three-way valve 8a, as shown in FIG. 9. The two-way valves 30a and 30b fitted to the indoor unit 6 and the valve 15 of the air absorbing device 13 were then opened to communicate the air absorbing device 13 with the indoor unit 6 and the pipe lines 7 so that zeolite may be exposed to carbon dioxide and a slight amount of air in the indoor unit 6 and the pipe lines 7. Upon the lapse of 30 minutes, the valve 15 was closed, and the air absorbing device 13 was removed. The port 12a was covered with a seal cap, and the valves 8a and 8b were opened to introduce the refrigerant into the indoor unit 6.

After a 3,000-hour continuous operation of the refrigeration system, the lubricating oil was taken out for observation thereof. Deterioration of the lubricating oil by oxidation was not observed, and the lubricating oil still had a total acid number of 0.01 mgKOH/g equal to the initial value (0.01 mgKOH/g) exhibited at the start of the operation.

(EMBODIMENT 4)

The outdoor and indoor units 5 and 6 were fixed at their installation positions and connected with each other by the pipe lines 7, to thereby construct a refrigeration system as shown in FIG. 1. HFC refrigerant and ester-based lubricating oil were respectively sealed in the outdoor unit 5 and in the refrigeration compressor 1 of the outdoor unit 5 in advance. At this moment, the indoor unit 6 was filled with air, the volume of which was about 1,000 $cm^3$.

Thereafter, a carbon dioxide absorbing device 21 was prepared as follows. In a nitrogen atmosphere, 100 grams of zeolite ("molecular sieve" manufactured by E. Merck and having a pore size of 1.0 nm) was accommodated in a 100 $cm^3$ stainless vessel 22, and a ball valve 23 was fitted thereto to selectively open or close its mouth. Then, a vacuum pump having an evacuation rate of 120 l/min was connected to the ball valve 23 via a rubber hose, and the vessel 22 was evacuated for one hour while being heated by a dryer. After the ball valve 23 was closed, the vacuum pump was removed from the vessel. Thereafter, a port connector 20 with a plunger pusher was connected to the ball valve 23 to complete the carbon dioxide absorbing device 21.

As shown in FIG. 3, a carbon dioxide cylinder employed as a carbon dioxide generating device 17 was connected to one (12a) of the ports 12a and 12b, while the other (12b) was opened to introduce carbon dioxide from the carbon dioxide generating device 17 into the system, thereby replacing the inside of the indoor unit 6 and the pipe lines 7 with carbon dioxide.

Thereafter, the introduction of carbon dioxide from the carbon dioxide generating device 17 was stopped, and the port 12b not connected to the carbon dioxide generating device 17 was closed. The carbon dioxide absorbing device 21 was then connected to the port 12a of the valve 8a, as shown in FIG. 4, and the valve 23 of the carbon dioxide absorbing device 21 was opened to expose zeolite to carbon dioxide in the indoor unit 6 and the pipe lines 7. Upon the lapse of two minutes, the valve 23 was closed, and the carbon dioxide absorbing device 21 was removed. The valves 8a and 8b were eventually opened to allow refrigerant to circulate through the outdoor unit 5, the pipe lines 7, and the indoor unit 6.

After a 3,000-hour continuous operation of the refrigeration system, the lubricating oil was taken out for observation thereof. Deterioration of the lubricating oil by oxidation was not observed, and the lubricating oil still had a total acid number of 0.02 mgKOH/g, which made no substantial difference from the initial value (0.01 mgKOH/g) exhibited at the start of the operation.

(EMBODIMENT 5)

The outdoor and indoor units 5 and 6 were fixed at their installation positions and connected with each other by the pipe lines 7, to thereby construct a refrigeration system as shown in FIG. 1. HFC refrigerant and ester-based lubricating oil were respectively sealed in the outdoor unit 5 and in the refrigeration compressor 1 of the outdoor unit 5 in advance. At this moment, the indoor unit 6 was filled with air, the volume of which was about 1,000 $cm^3$.

Thereafter, a carbon dioxide absorbing device 21 was prepared as follows. In a nitrogen atmosphere, a mixture of 20 grams of calcium hydroxide and 20 grams of calcium chloride was retained in a 100 $cm^3$ stainless vessel 22 having internal Teflon-lining, and a ball valve was fitted thereto to selectively open or close its mouth. Then, a vacuum pump having an evacuation rate of 120 l/min was connected to the ball valve via a rubber hose, and the vessel was evacuated for one minute. After the ball valve was closed, the vacuum pump was removed from the vessel. Thereafter, a port connector 20 with a plunger pusher was connected to the ball valve to complete the carbon dioxide absorbing device 21.

As shown in FIG. 3, a carbon dioxide cylinder employed as a carbon dioxide generating device 17 was connected to one (12*a*) of the ports 12*a* and 12*b*, while the other (12*b*) was opened to introduce carbon dioxide from the carbon dioxide generating device 17 into the system, thereby replacing the inside of the indoor unit 6 and the pipe lines 7 with carbon dioxide.

Thereafter, the introduction of carbon dioxide from the carbon dioxide generating device 17 was stopped, and the port 12*b* not connected to the carbon dioxide generating device 17 was closed. The carbon dioxide absorbing device 21 was then connected to the port 12*a*, as shown in FIG. 4, and the valve 23 of the carbon dioxide absorbing device 21 was opened to expose the mixture of calcium hydroxide and calcium chloride to carbon dioxide in the indoor unit 6 and the pipe lines 7. Upon the lapse of 30 minutes, the valve 23 was closed, and the carbon dioxide absorbing device 21 was removed. The port 12*a* was sealed with a seal cap, and the valves 8*a* and 8*b* were eventually opened to allow refrigerant to circulate through the outdoor unit 5, the pipe lines 7, and the indoor unit 6, thus completing the refrigeration system.

After a 3,000-hour continuous operation of the refrigeration system, the lubricating oil was taken out for observation thereof. Deterioration of the lubricating oil by oxidation was not observed, and the lubricating oil still had a total acid number of 0.02 mgKOH/g, which made no substantial difference from the initial value (0.01 mgKOH/g) exhibited at the start of the operation.

(EMBODIMENT 6)

The outdoor and indoor units 5 and 6 were fixed at their installation positions and connected with each other by the pipe lines 7, to thereby construct a refrigeration system as shown in FIG. 1. HFC refrigerant and ester-based lubricating oil were respectively sealed in the outdoor unit 5 and in the refrigeration compressor 1 of the outdoor unit 5 in advance. At this moment, the indoor unit 6 was filled with air, the volume of which was about 1,000 $cm^3$.

Figure 10:
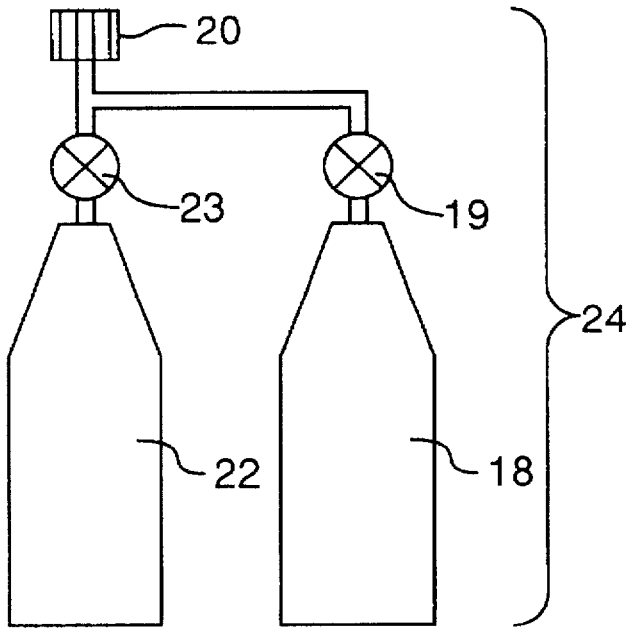
FIG. 10 is a schematic view of the device of the integral structure shown in FIG. 5.

Thereafter, a device 24 of an integral structure comprising a carbon dioxide generating device and a carbon dioxide absorbing device as shown in FIG. 10 was prepared as follows. In a nitrogen atmosphere, 20 grams (0.133 mol) of phenyl glycidyl ether being of a kind of epoxy compound, and 0.36 grams (0.0023 mol) of zinc chloride and 3.43 grams (0.0107 mol) of tetrabutylammonium bromide, both used as reaction catalysts for fixing carbon dioxide, were retained in a 100 $cm^3$ stainless vessel 22, and a ball valve 23 was fitted thereto to selectively open or close its mouth. Then, a vacuum pump having an evacuation rate of 120 l/min was connected to the ball valve 23 via a rubber hose, and the vessel was evacuated for one minute. After the ball valve 23 was closed, the vacuum pump was removed from the vessel.

Furthermore, a cylinder 18 having a valve 19 and filled with 5,000 $cm^3$ carbon dioxide in terms of atmospheric pressure was connected with the stainless vessel 22 having the ball valve 23 via a stainless pipe, to which a port connector 20 having a plunger pusher was connected to complete the device 24 of the integral structure.

As shown in FIG. 5, the device 24 of the integral structure was connected to the port 12*a*, and the valve 19 was opened to introduce carbon dioxide into the system, while a joint between the valve 8*b* and the pipe line 7 was loosened to allow leakage, thereby replacing the inside of the indoor unit 6 and the pipe lines 7 with carbon dioxide. Thereafter, the valve 19 was closed to stop the introduction of carbon dioxide from the cylinder 18, and the joint between the valve 8*b* and the pipe line 7 were tightened. The valve 23 was then opened to expose the mixture in the vessel 22 to carbon dioxide in the indoor unit 6 and the pipe lines 7. Upon the lapse of 30 minutes, the valve 23 was closed, and the device 24 of the integral structure was removed from the port 12*a*. The port 12*a* was then sealed with a seal cap, and the valves 8*a* and 8*b* were eventually opened to allow refrigerant to circulate through the outdoor unit 5, the pipe lines 7, and the indoor unit 6.

After a 3,000-hour continuous operation of the refrigeration system, the lubricating oil was taken out for observation thereof. Deterioration of the lubricating oil by oxidation was not observed, and the lubricating oil still had a total acid number of 0.02 mgKOH/g, which made no substantial difference from the initial value (0.01 mgKOH/g) exhibited at the start of the operation.

(COMPARATIVE EXAMPLE)

The outdoor and indoor units were fixed at their installation positions and connected with each other by the pipe lines, to thereby construct the same refrigeration system as that of Embodiment 1. HFC refrigerant and ester-based lubricating oil were respectively sealed in the outdoor unit and in the refrigeration compressor of the outdoor unit in advance. At this moment, the indoor unit was filled with air, the volume of which was about 1,000 $cm^3$.

Thereafter, the valves 8*a* and 8*b* were both opened to communicate the outdoor and indoor units with each other.

After a 3,000-hour continuous operation of the refrigeration system, the lubricating oil was taken out for observation thereof. The lubricating oil turned yellow and deterioration thereof progressed.

As discussed in detail hereinabove, according to one form of the present invention, because an air absorbing device containing zeolite as an adsorbent is fitted to the refrigeration system to remove air contained therein, it is not necessary to operate a vacuum pump, unlike the conventional method. Also, because no refrigerant is discharged to the atmosphere, the method of the present invention is gentle with the environment, and because no air remains in the refrigeration system, deterioration of the refrigeration system is prevented.

The repeated use of zeolite makes the installation of the refrigeration system inexpensive.

Furthermore, because carbon dioxide is sealed in the indoor unit in advance, gas in the indoor unit can be rapidly removed.

Because zeolite has an average pore size greater than 0.4 nm, moisture contained in the indoor unit is prevented from lowering the adsorption rate of air.

Furthermore, because the air absorbing device contains more than 20 grams of zeolite per 1 liter of air contained in the indoor unit and the pipe lines, the degassing rate can be increased.

According to another form of the present invention, the inside of the indoor unit or the pipe lines is replaced with carbon dioxide, which is in turn absorbed by a carbon dioxide absorbing device attached to the refrigeration system. This method does not require operation of a vacuum pump, unlike the conventional method. Because no refrigerant is discharged to the atmosphere, the method of the present invention is gentle with the environment, and because no air remains in the refrigeration system, deterioration of the refrigeration system is prevented.

When the carbon dioxide absorbing device contains zeolite, it effectively absorbs carbon dioxide at room temperatures and can be repeatedly used.

When the carbon dioxide absorbing device contains calcium hydroxide and calcium chloride, carbon dioxide is removed by calcium hydroxide, while a reaction product, i.e, water is removed by calcium chloride.

When the carbon dioxide absorbing device contains an epoxy compound, it effectively absorbs carbon dioxide and is easy to handle.

According to a further form of the present invention, at least part of the refrigeration system is filled with an inert gas, which is in turn cooled below a condensation temperature thereof by a condensing and collecting device attached to the refrigeration system. By so doing, the inert gas is condensed and collected by the condensing and collecting device. According to this method, inert gases other than carbon dioxide can be used.

The refrigeration system of the present invention is at least partially filled with carbon dioxide, which is in turn absorbed by a carbon dioxide absorbing device. Accordingly, it is not necessary to operate a vacuum pump, unlike the conventional method. Also, because no refrigerant is discharged to the atmosphere, the refrigeration system of the present invention is gentle with the environment, and because no air remains in the refrigeration system, deterioration of the refrigeration system is prevented.

If the carbon dioxide absorbing device is provided with an oil separation mechanism fitted to a refrigerant flow channel leading thereto, lubricating oil and carbon dioxide absorbing material do not come into contact with each other, thus preventing deterioration of the lubricating oil.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A method of installing a refrigeration system which includes an outdoor unit having a refrigeration compressor and a heat exchanger, and an indoor unit having a heat exchanger to be placed where air conditioning is desired, said method comprising the steps of:

connecting the outdoor unit with the indoor unit with pipe lines;

replacing gas inside of at least one of the indoor unit and the pipe lines with carbon dioxide;

connecting a carbon dioxide absorbing device on one of the outdoor unit, the indoor unit and the pipe lines and removing the carbon dioxide inside of at least one of the indoor unit and the pipe lines by absorbing the carbon dioxide with the carbon dioxide absorbing device;

disconnecting the carbon dioxide absorbing device from the one of the outdoor unit, the indoor unit and the pipe lines; and circulating refrigerant through the refrigeration system.

2. The method of claim 1, wherein said step of connecting a carbon dioxide absorbing device comprises connecting the carbon dioxide absorbing device to a valve in the refrigeration system.

3. The method of claim 2, wherein the valve has a port for connecting with the carbon dioxide absorbing device.

4. The method of claim 2, wherein the valve can communicate and close off from each other the indoor unit and the outdoor unit.

5. The method of claim 1, wherein said step of replacing comprises connecting a source of carbon dioxide to the refrigeration system, filling the one of the indoor unit and the pipelines with carbon dioxide from the source, and allowing the gas to escape the refrigeration system during filling.

6. The method according to claim 1, wherein the carbon dioxide absorbing device contains calcium hydroxide and calcium chloride.

7. The method according to claim 1, wherein the carbon dioxide absorbing device contains an epoxy compound.

* * * * *

UNITED STATES PATENT AND TRADEMARK OFFICE

CERTIFICATE OF CORRECTION

PATENT NO. : 5,718,119

DATED : February 17, 1998

INVENTOR(S) : Katsuya WAKITA et al.

It is certified that error appears in the above-identified patent and that said Letters Patent is hereby corrected as shown below:

Please add claim 8 as follows:

8. The method according to claim 1, wherein the carbon dioxide absorbing device contains zeolite.

Signed and Sealed this

Eighth Day of February, 2000

*Attest:*

*Attesting Officer*

Q. TODD DICKINSON

*Commissioner of Patents and Trademarks*